US011653705B2

(12) United States Patent
McCombs et al.

(10) Patent No.: US 11,653,705 B2
(45) Date of Patent: May 23, 2023

(54) UNDERGARMENT FOR A MALE WEARER

(71) Applicant: Tyler McCombs, Calgary (CA)

(72) Inventors: Tyler McCombs, Calgary (CA); Martina Carello, Calgary (CA)

( * ) Notice: Subject to any disclaimer, the term of this patent is extended or adjusted under 35 U.S.C. 154(b) by 0 days.

(21) Appl. No.: 16/773,221

(22) Filed: Jan. 27, 2020

(65) Prior Publication Data

US 2020/0237020 A1 Jul. 30, 2020

Related U.S. Application Data

(60) Provisional application No. 62/797,679, filed on Jan. 28, 2019.

(51) Int. Cl.
*A41B 9/02* (2006.01)

(52) U.S. Cl.
CPC ..... *A41B 9/023* (2013.01)

(58) Field of Classification Search
CPC ..... A41B 9/023; A41B 9/001; A41B 9/004; A41B 9/02; A41B 9/026
See application file for complete search history.

(56) References Cited

U.S. PATENT DOCUMENTS 1,254,463 A * 1/1918 Arrington, Jr. ..... A41B 9/02 2/400
2,214,578 A * 9/1940 Davis ..... A41B 9/02 2/403
2,624,336 A * 1/1953 Hansley ..... A61F 5/40 2/404
2,641,257 A * 6/1953 Rutledge ..... A61F 13/72 2/403
3,038,471 A * 6/1962 Van Horne ..... A41B 9/02 2/403
3,166,764 A * 1/1965 Stedman ..... A41B 9/02 2/403
3,220,410 A * 11/1965 Sloan ..... A41B 9/02 2/405
3,844,282 A * 10/1974 King ..... A41B 9/023 2/405
4,141,357 A * 2/1979 Dietz ..... A41B 9/023 602/73
4,377,008 A * 3/1983 Jung ..... A41B 9/023 2/403
4,509,512 A * 4/1985 LeClercq ..... A41B 9/008 602/67
4,554,685 A * 11/1985 Ray ..... A41B 9/02 2/403
4,695,279 A * 9/1987 Steer ..... A61F 13/472 604/397
4,870,958 A * 10/1989 Webster ..... A61F 5/40 2/404

(Continued)

*Primary Examiner* — Heather Mangine
*Assistant Examiner* — Raquel M. Weis
(74) *Attorney, Agent, or Firm* — Boyle Fredrickson, S.C.

(57) ABSTRACT

A male undergarment has a pouch on an inside surface of the front section defined by two of fabric flap portions where each fabric flap portion is folded to define two overlying sheets of the fabric with edges of the sheets stitched into the seam and a folded edge spaced from the first seam toward the crease between the inner thigh and the groin of the wearer so that the crease and inner thigh engage the folded edge rather than the seam for improved comfort. A similar folded flap portion can be provided at the junction between the thigh and the groin.

8 Claims, 3 Drawing Sheets

(56) References Cited

U.S. PATENT DOCUMENTS 5,029,345 A * 7/1991 Angheluta ..... A41B 9/023 2/403
5,524,298 A * 6/1996 Plunkett ..... A41B 9/023 2/403
5,647,065 A * 7/1997 Richerson ..... A41B 9/023 2/403
5,669,902 A * 9/1997 Sivilich ..... A61F 13/471 604/397
5,870,779 A * 2/1999 Heron ..... A41B 9/023 2/403
5,875,495 A * 3/1999 Thrower ..... A41B 9/023 2/403
6,038,703 A * 3/2000 Chung ..... A61F 5/40 2/403
6,425,140 B1 * 7/2002 Vitches ..... A41B 9/02 2/403
6,901,607 B1 * 6/2005 Elwell ..... A41B 9/023 2/403
7,676,853 B1 * 3/2010 Cutlip ..... A41B 9/023 2/403
7,958,571 B2 * 6/2011 Kitsch ..... A41B 9/023 2/403
D646,462 S * 10/2011 Ellis ..... A41B 9/026 D2/742
8,092,273 B2 * 1/2012 Shinomiya ..... A41B 9/001 450/97
D656,708 S * 4/2012 Ellis ..... D2/712
8,615,816 B2 * 12/2013 Harimoto ..... A41B 9/02 2/403
9,301,550 B2 * 4/2016 Sabin ..... A41D 1/06
9,314,052 B2 * 4/2016 Donmoyer ..... A41B 9/023
9,375,035 B1 * 6/2016 Ingels ..... A41B 9/004
9,539,151 B2 * 1/2017 Vartiainen ..... A61F 13/4915
9,687,030 B2 * 6/2017 Bigney ..... A41B 9/02
D809,242 S * 2/2018 Kimel ..... D2/712
D809,243 S * 2/2018 Kimel ..... D2/712
10,053,804 B2 * 8/2018 Frantz ..... A41B 9/02
2004/0025218 A1 * 2/2004 Huang ..... A41B 9/023 2/73
2005/0050616 A1 * 3/2005 Krautbauer ..... A41B 9/001 2/400
2005/0235399 A1 * 10/2005 Kang ..... A41B 9/023 2/403
2006/0162052 A1 * 7/2006 Stankowski ..... A41B 9/02 2/403
2007/0044209 A1 * 3/2007 Maurer ..... A41B 9/023 2/403
2007/0220661 A1 * 9/2007 Blohmann ..... A41B 9/023 2/404
2007/0245463 A1 * 10/2007 Kang ..... A41B 9/023 2/403
2008/0109945 A1 * 5/2008 Xia ..... A41B 9/023 2/403
2008/0178369 A1 * 7/2008 Kitsch ..... A41B 9/023 2/405
2009/0158505 A1 * 6/2009 Fleming ..... A61F 13/471 2/403
2009/0288240 A1 * 11/2009 Lim ..... A41B 9/023 2/403
2010/0005561 A1 * 1/2010 Holland ..... A41B 9/023 2/403
2010/0170028 A1 * 7/2010 Edwardsen ..... A41B 9/023 2/404
2012/0167279 A1 * 7/2012 Bigney ..... A41B 9/02 2/401
2012/0255102 A1 * 10/2012 Soderstrom ..... A41B 9/023 2/403
2014/0047620 A1 * 2/2014 Ingalls ..... A41B 9/02 2/403
2014/0059744 A1 * 3/2014 Lin ..... A41B 9/023 2/403
2015/0047108 A1 * 2/2015 Crissman ..... A41B 9/026 2/405
2015/0181946 A1 * 7/2015 Donmoyer ..... A41B 9/004 2/403
2015/0223524 A1 * 8/2015 Brady ..... A41D 1/089 450/156
2017/0238619 A1 * 8/2017 Shupe ..... A41B 9/023
2018/0007975 A1 * 1/2018 Crump ..... A41B 9/001
2018/0070650 A1 * 3/2018 Cooper ..... A41B 9/023
2018/0084837 A1 * 3/2018 Ng ..... A41B 9/023
2018/0310633 A1 * 11/2018 Harris ..... A41B 9/026
2018/0327942 A1 * 11/2018 Frantz ..... A41B 9/02
2019/0116889 A1 * 4/2019 Kimel ..... A41B 9/023

* cited by examiner

FIG. 6
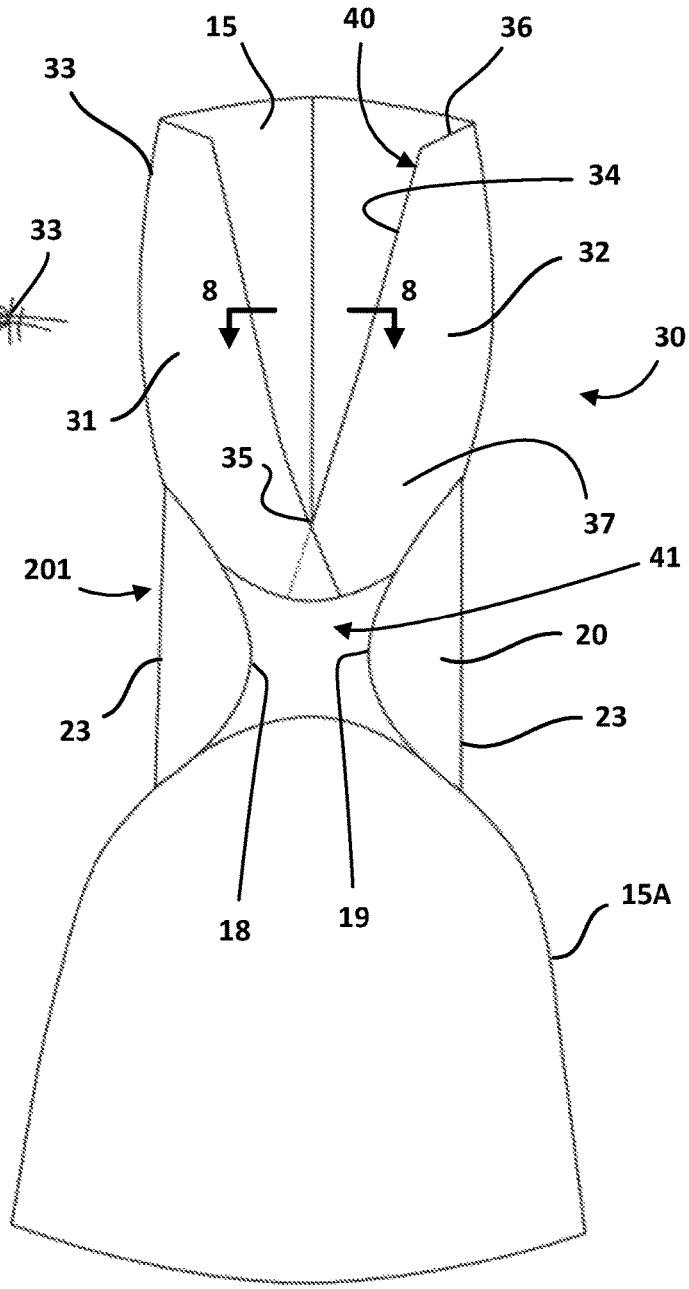
FIG. 8
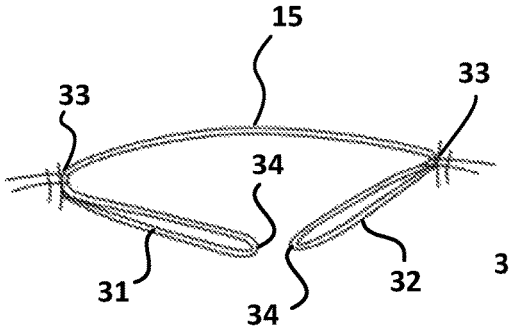
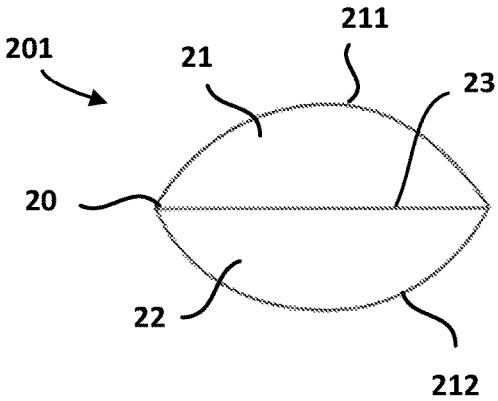
FIG. 7

UNDERGARMENT FOR A MALE WEARER

This application claims the benefit under 35 USC 119(e) of Provisional Application 62/797,679 filed Jan. 28, 2019, the disclosure of which is incorporated herein by reference.

This invention relates to an undergarment for a male wearer and particularly to an undergarment of the type generally known as boxer shorts where the garment includes a waistband, fabric components attached to the waistband and stitched together to form a main garment body surrounding the lower body of the wearer around and underneath the crotch of the wearer and defining a front section adjacent the genitals of the wearer and a rear section covering the buttocks of the wearer and left and right leg portions each surrounding a respective thigh of the wearer. This type of garment is particularly popular and many attempts are made to improve the comfort of the wearer.

SUMMARY OF THE INVENTION

It is an object of the present invention to provide an undergarment of increased comfort for the wearer.

According to the invention, there is provided an undergarment for a male wearer comprising:

a waistband;

fabric components attached to the waistband and stitched together to form:

a main garment body surrounding the lower body of the wearer around and underneath the crotch of the wearer and defining a front section adjacent the genital area of the wearer and a rear section covering the buttocks of the wearer;

left and right leg portions each surrounding a respective thigh of the wearer;

a first seam joining the left leg portion to the main garment body at the left inner thigh of the wearer and extending from the front portion along the left inner thigh to the rear section;

a second seam joining the right leg portion to the main garment body at the right inner thigh of the wearer and extending from the front portion along the right inner thigh to the rear section;

a pouch portion at the front section having third and fourth seams, one on each side of the genital area of the garment, each seam extending from the waistband to a position at or adjacent the leg portions;

a first fabric portion stitched along at least one of the first and third seams and a second fabric portion stitched along at least one of the second and fourth seams;

the first fabric portion being folded to define two overlying sheets of the fabric with edges of the sheets stitched into said one of the first and third seams and a folded edge spaced from said one of the first and third seams so that the skin of the wearer engages the folded edge for improved comfort;

the second fabric portion being folded to define two overlying sheets of the fabric with edges of the sheets stitched into said one of the second and fourth seams and a folded edge spaced from said one of the second and fourth seams so that the skin of the wearer engages the folded edge for improved comfort.

The arrangement herein therefore provides a unique design for men's boxers that helps protect the user from unwanted skin on skin contact. The main innovation is the formation of the fabric portions from a folded sheet so that the folded edge engages the skin of the wearer rather than a raw edge.

In a first embodiment, the first fabric portion is arranged at the first seam and the second fabric portion is arranged at the second seam so as to provide additional flap portions at the junction between the thigh and the groin.

Preferably, in this embodiment, the first and the second flap portions are C-shaped, where the outer edge being curved and the inner edge being straight.

The top half of the fabric at the fold is held up by tension along the fold generated by connecting to the front and back section of the main garment body of the boxer. The bottom part of the fabric portion is sewn into seam of the boxer itself.

In a second embodiment, the fabric portions are arranged at the third and fourth seams to provide a fabric portion that separates a male's external genitals from touching his legs. The arrangement provides a unique design by having two pieces of fabric, with each also being folded in half, that start at the top, separate, and cross over each other near the bottom of the boxers, which is represented in FIG. 6 as crotch panel 41. This creates a pouch effect which separates the male genitals from the rest of the body. This is also done to prevent skin on skin contact and increase comfort for the user.

To add further clarification to the arrangement, the fabric is folded in half, where the middle of the fabric portion at the fold line 40 defines the "top half" and the ends of the fabric being the "bottom" which is all sewn into the seam of the boxer. This is done to cause less discomfort for the user and allow the fabric to better form itself to the user's leg. That is, the fabric engaging the wearer is soft and free from seams. A suitable fabric is selected which can flex and slide across itself. Thus, the two sides of the fabric can each distort relative to the other to take up movement of the adjacent skin of the wearer. Thus, the fold line has no stiffness as the fabric can fold in half at the 180-degree fold without generating increased stiffness at the fold line. The fold line also reaches into the crease in the skin so as to separate the two skin surfaces at the crease and avoid skin on skin rubbing. The tension in the folded edge pulls the edge into its crease at the fold line.

In accordance with a further innovation, the fabric on the back half of the boxer is slightly higher than the front side of the boxer to help the user from exposing his behind when he bends over.

That is, there is provided a pouch on an inside surface of the front section defined by two fabric flap portions, one on each side of the genitals wherein an outer edge is stitched into a seam of the fabric components and extends across from one side at the front to the opposite side at the rear to define an inner edge of each flap portion which starts at or adjacent the waistband and extends downward and across the genitals so that the inner edges cross over at a position adjacent the bottom of the front section to form a pouch.

Preferably, the first fabric flap portion (or pouch flap) is folded to define two overlying sheets of the fabric with edges of the sheets stitched into the first seam and a folded edge spaced from the first seam toward the crease between the inner thigh and the groin of the wearer so that the crease and inner thigh engage the folded edge rather than the seam for improved comfort and the second fabric flap portion being folded to define two overlying sheets of the fabric with edges of the sheets stitched into the first seam and a folded edge spaced from the first seam toward the crease between the inner thigh and the groin of the wearer so that the crease and inner thigh engage the folded edge rather than the seam for improved comfort.

Preferably the pouch flaps are narrower at the top and wider at the bottom.

Preferably the pouch flaps have tension therein achieved by using an elastic for at least some of the fabric panels.

Preferably the pouch flaps have tension therein achieved by cutting the diagonal part of the panel on the fold and the grain.

Preferably the pouch flaps have the grain of the fabric in the direction with the least stretch.

Preferably the pouch flaps' narrower top portion is cut on an angle in which pulls up to meet the waistband to increase tension.

Preferably the pouch flaps are arranged such that the wider lower portion is cut in the same curve as the outer edge of the pouch, however, the curve on the inner panel is shaped a minimum of one half inch higher than the outer edge of the pouch, Preferably the pouch flaps are formed so that there is no elastic strip used with the fabric and the elasticity is provided by the fabric itself.

In accordance with a further aspect of the invention there is provided an undergarment for a male wearer comprising:

a waistband;

fabric components attached to the waistband and stitched together to form a main garment body surrounding the lower body of the wearer around and underneath the crotch of the wearer and defining a front section adjacent to and covering the genitals of the wearer and a rear section covering the buttocks of the wearer;

and a pouch on an inside surface of the front section defined by two fabric flap portions, one on each side of the genitals wherein an outer edge is stitched into a seam of the fabric components and extends across from one side at the front to the opposite side at the rear to define an inner edge of each flap portion which starts at or adjacent the waistband and extends downward and across the genitals so that the inner edges cross over at a position adjacent the bottom of the front section to form a pouch;

the first fabric flap portion being folded to define two overlying sheets of the fabric with edges of the sheets stitched into the first seam and a folded edge spaced from the first seam toward the crease between the inner thigh and the groin of the wearer so that the crease and inner thigh engage the folded edge rather than the seam for improved comfort;

and the second fabric flap portion being folded to define two overlying sheets of the fabric with edges of the sheets stitched into the first seam and a folded edge spaced from the first seam toward the crease between the inner thigh and the groin of the wearer so that the crease and inner thigh engage the folded edge rather than the seam for improved comfort.

The arrangement herein provides a construction which is different from prior art arrangements in that:

The prior art flap portions have wider top and narrower bottom while the present arrangement is narrower at the top and wider at the bottom.

The tension is achieved by potentially using an elastic for some fabrics. It is also indicated that the diagonal edges will also form a hoisting effect (or tension) to hold the parts in place and away from the thighs.

In the present arrangement, tension is achieved by cutting the diagonal part of the panel on the fold and the grain, with the grain of the fabric is the direction with the least stretch in most fabrics. The narrower top portion is cut on an angle which pulls up to meet the waistband to increase tension. The wider lower portion is cut in the same curve as the outer edge of the pouch, however, the curve on the inner panel is shaped a minimum of ½" higher than the outer edge of the pouch. There are no elastic strips used.

The fabric portions forming the pouch may be triangular, trapezoidal, L-shaped or one with preferably a narrower top and wider bottom.

The inner panel when opened (before folding) is shaped like a tear drop or eggplant shape with a very prominent "V" at the center top.

The narrow top center "V" shape is half inch deep. When folded, creates an angle and pulls up to meet the waistband (see point above).

The center of the piece is cut on grain and folded.

Cross over in an "X" formation forms either a "U" or "V" shaped pouch opening.

The present arrangement does cross over as an "X" and forms a "V" shaped pouch opening.

The cross over or "X" is merely 0.75 inch at the center whereas in the prior art, the cross over not only crosses completely but also attaches itself to the opposite sides too and forms a "V"

BRIEF DESCRIPTION OF THE DRAWINGS

One embodiment of the invention will now be described in conjunction with the accompanying drawings in which:

FIG. 6 is a top plan view of a central part only of the garment of FIG. 1.

FIG. 7 is an expanded view of one flap portion of the embodiment of FIG. 1 showing the construction prior to folding.

FIG. 8 is a cross-sectional view along the lines 8-8 in FIG. 6.

In the drawings like characters of reference indicate corresponding parts in the different figures.

DETAILED DESCRIPTION

Figure 2:
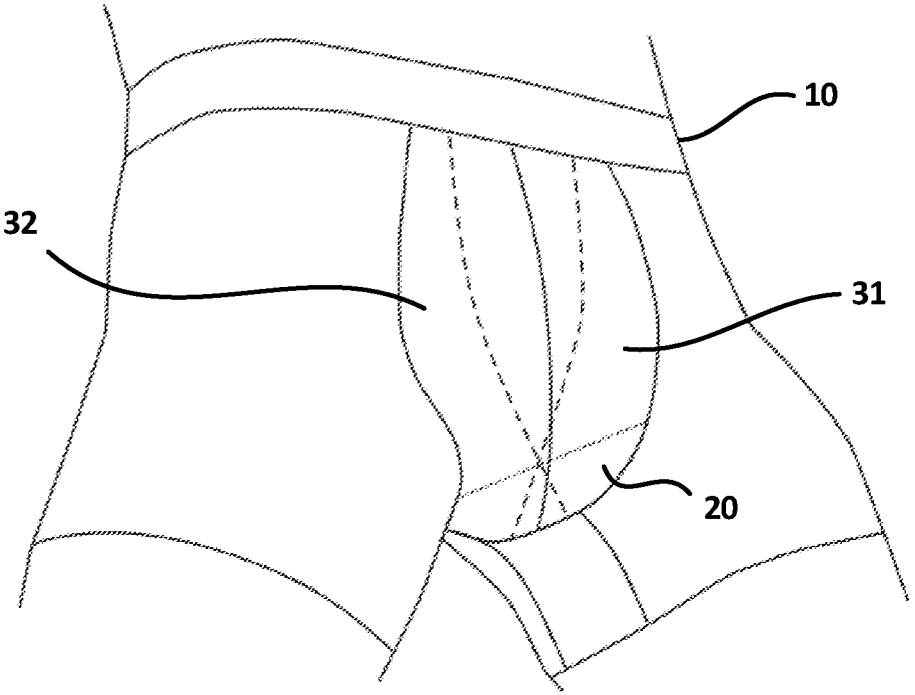
FIG. 2 is an isometric view of the garment of FIG. 1.
Figure 1:
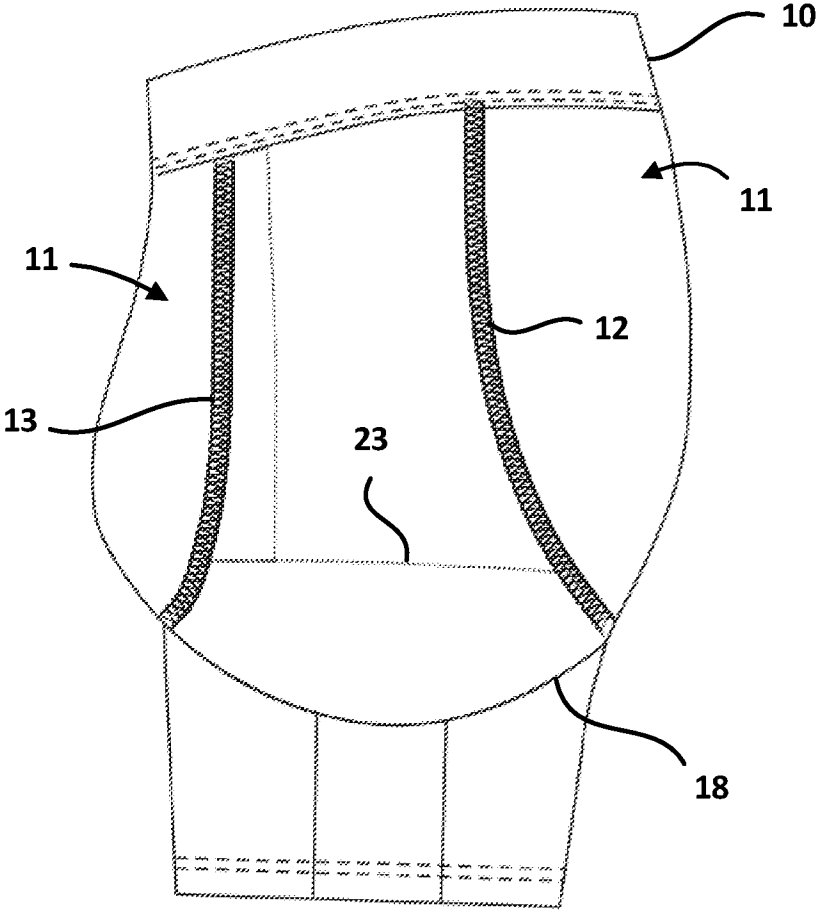
FIG. 1 is a cross-sectional view along a center line showing the basic construction of the garment and according to the present invention including folded thigh and pouch guard fabric portions.
Figure 4:
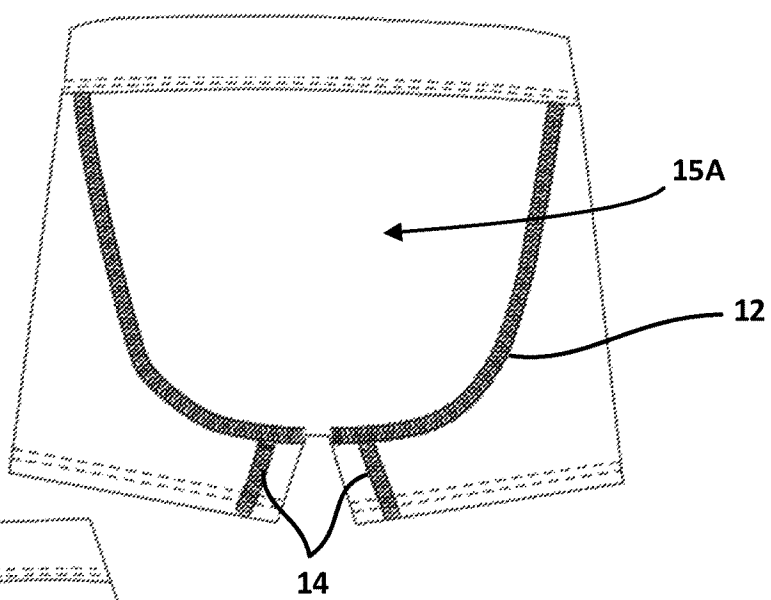
FIG. 4 is a rear elevational view of the garment of FIG. 1.

The undergarment for a male wearer includes a waistband 10 and fabric components 11 attached to the waist band 10 and stitched together at stitch lines 12, 13, 14 to form a main garment body surrounding the lower body of the wearer around and underneath the crotch of the wearer and defining a front section 15 adjacent the genitals of the wearer and a rear section 15A covering the buttocks of the wearer. In the boxer style garment, there are provided left and right leg portions 17, 16, respectively each surrounding a respective thigh of the wearer.

A first seam 18 joins the left leg portion to the main garment body at the left inner thigh of the wearer and extending from the front portion along the left inner thigh to the rear section. A second seam 19 joins the right leg portion to the main garment body at the right inner thigh of the wearer and extending from the front portion along the right inner thigh to the rear section;

Referring to FIG. 8, each of the fabric flap portions is folded in the same manner as shown in FIG. 7 to define two overlying sheets of fabric with outer edges 33 of the two sheets stitched into the first seam and a folded edge 34 spaced from the first seam.

The pouch flaps 30, 31 are narrower at a top edge 36 and wider at the bottom 37. The inner edges 34 cross over at the point 35 at or closely adjacent the bottom of the front section 15 and the inner edges 34 are spaced at the top 36 by a distance greater than the width of the flap portions at the top.

The arrangement of the pouch mentioned above provides two pieces of fabric that crosses over at the bottom of the boxer, where the leg holes begin.

The top line is the fold of the fabric. It is held up by tension from where it connects on the front wall of the boxer. The bottom of the fabric is sewn together along the seam that runs under the groin.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not limiting.

Describing the thigh panel, a first fabric portion 20 is stitched along the first seam 18 and a second fabric portion 20 is stitched along the second seam 19. Each of the first and second fabric portions 20 being folded along a fold line at the middle of fabric portion 20 to define two overlying sheets 21, 22 of the fabric 20 with outer edges 211, 212 of the sheets 21 and 22, respectively. The pair of outer edges 211 and 212 of the first and second fabric portion 20 are stitched together into the first seam 18 and second seam 19, respectively. When fabric portion 20 in the first fabric portion 20 is folded, edge 23 is defined to be the edge of fabric 20 opposing edges 211 and 212 and spaced away from the first seam 18 toward a crease between the left inner thigh and the groin of the wearer so that the crease and inner thigh engage the folded edge 23 rather than the seam 18 for improved comfort. The first and second fabric portions 20, when in the folded configuration, are therefore shaped as a half ellipse where the outer edge 211, 212 is curved and the inner edge 23 is straight. The grain line of the fabric is arranged along the fold.

Figure 3:
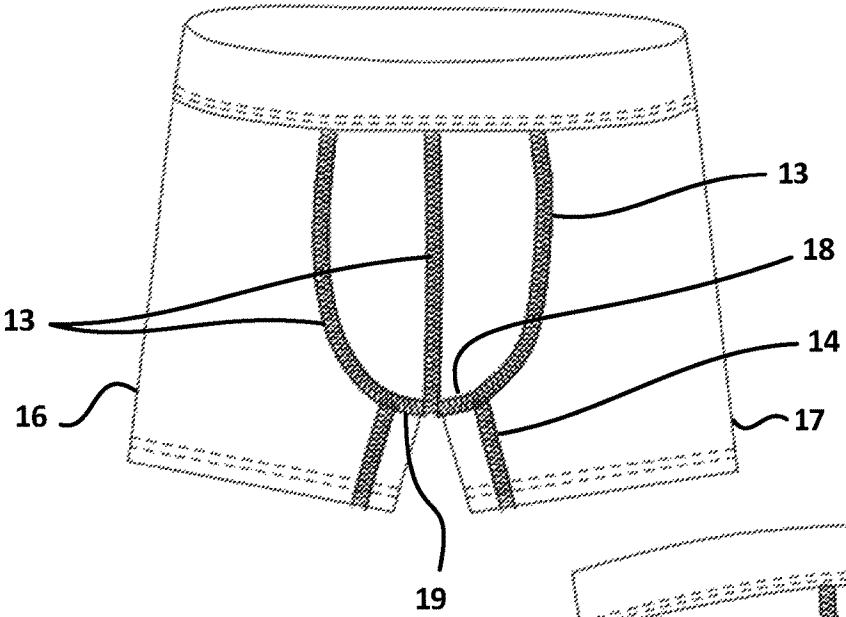
FIG. 3 is a front elevational view of the garment of FIG. 1.
Figure 5:
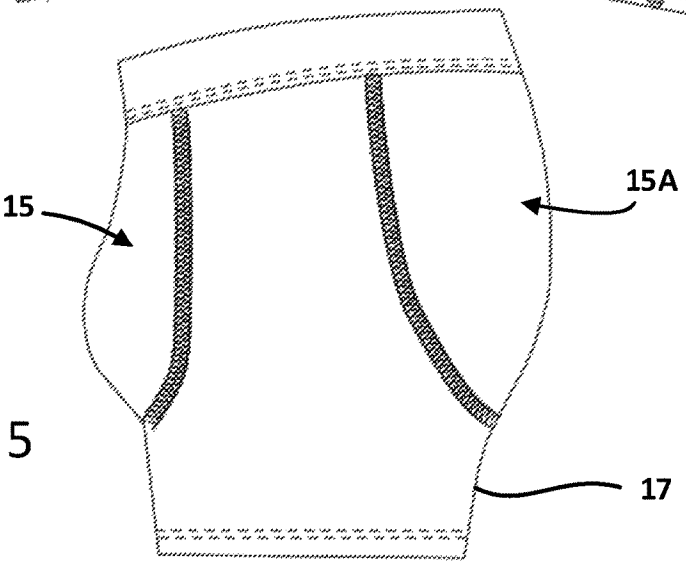
FIG. 5 is a side elevational view of the garment of FIG. 1.

As shown in FIGS. 2, 3 and 6 there is provided a pouch 30 on an inside surface of the front section 15 defined by two fabric flap portions 31, 32 (also described as pouch flaps), one on each side of the genitals wherein an outer edge 33 is stitched into a seam of the fabric components and extends across from one side at the front to the opposite side at the front to define an inner edge 34 of each flap portion which starts at or adjacent the waistband and extends downward and across the genitals so that the inner edges cross over at a position 35 adjacent the bottom of the front section to form a pouch 30.

The invention claimed is:

1. An undergarment for a male wearer comprising:

a waistband;

fabric components attached to the waistband and stitched together at a plurality of seams to form a main garment body for surrounding a lower body of the male wearer around and underneath a crotch of the male wearer, the main garment body defining a front section adjacent to and covering genitals of the male wearer and a rear section for covering a buttocks of the male wearer; and a fabric pouch on an inside surface of the front section, the fabric pouch defined by a first fabric flap portion and a second fabric flap portion, the first fabric flap portion and the second fabric flap portion each having a top edge stitched to or adjacent to the waistband, a bottom edge stitched to a crotch panel of the undergarment inward of terminal ends of the crotch panel, an inner edge and an outer edge, each of the outer edges is stitched into at least one of the plurality of seams so as to extend from the top edge downward to form stitched sides of the fabric pouch, where the outer edges are configured to be on opposite sides of the genitals of the male wearer when the undergarment is worn, the inner edge of each of the first fabric flap portion and the second fabric flap portion is tensioned and extending diagonally from the respective top edge to the respective bottom edge such that the inner edge of the second fabric flap portion overlaps the inner edge of the first fabric flap portion near the crotch panel, wherein the inner edge of the first fabric flap portion terminates at the crotch panel between the genitals of the male wearer and a first inner thigh of the male wearer, and the inner edge of the second fabric flap portion terminates at the crotch panel between the genitals of the male wearer and a second inner thigh of the male wearer when the undergarment is worn by the male wearer.

2. The undergarment according to claim 1 wherein each of the first fabric flap portion and the second fabric flap portion is narrow at the top edge and wide at the bottom edge; and wherein the inner edges are spaced apart at the top edge by a distance greater than a width of the top edge.

3. The undergarment according to claim 1 wherein each of the first fabric flap portion and the second fabric flap portion is formed by folding a fabric in half along a folding line to define two sheets corresponding in shape to one another and overlying one another, wherein the outer edge is defined by an outer edge for each of the two sheets overlying one another and the inner edge is defined to be a single edge shared by the two sheets along the folding line.

4. The undergarment according to claim 3 wherein the fabric is folded in half at a 180-degree fold.

5. The undergarment according to claim 3, wherein the inner edge is tensioned independent from an external tape or an elastic band.

6. The undergarment according to claim 3, wherein the two sheets are configured to flex, slide, and distort relative to one another to accommodate for movement of an adjacent skin of the male wearer, when the undergarment is worn by the male wearer.

7. The undergarment according to claim 1 wherein the fabric is elastic.

8. The undergarment according to claim 1 wherein for each of the first fabric flap portion and the second fabric flap portion, the top edge is cut on an angle and the inner edge is tensioned by having the bottom edge stitched to the crotch panel of the undergarment inward of terminal ends of the crotch panel and having the top edge pulled up to meet and be stitched to the waistband.

* * * * *